US006796356B2

(12) United States Patent
Kirby

(10) Patent No.: US 6,796,356 B2
(45) Date of Patent: Sep. 28, 2004

(54) FOLDING SHADES HAVING MINIMAL SAG WHEN FOLDED

(75) Inventor: David A. Kirby, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/260,835

(22) Filed: Sep. 30, 2002

(65) Prior Publication Data

US 2004/0060667 A1 Apr. 1, 2004

(51) Int. Cl.[7] ..... E06B 9/06
(52) U.S. Cl. ..... 160/84.06; 160/50
(58) Field of Search ..... 160/45, 61, 62, 160/76, 81, 83.1, 40, 84.01, 84.02, 84.06, 84.08, 352; 52/63, 222

(56) References Cited

U.S. PATENT DOCUMENTS 1,813,017 A * 7/1931 Bond ..... 49/87.1
2,187,639 A * 1/1940 Bond ..... 49/82.1
3,564,784 A * 2/1971 Mollinger ..... 52/63
4,062,146 A * 12/1977 Grossman et al. ..... 47/17
4,683,933 A * 8/1987 Dunbar ..... 160/273.1
6,079,472 A * 6/2000 Schanz ..... 160/265
6,119,755 A * 9/2000 Oskam ..... 160/84.02

FOREIGN PATENT DOCUMENTS

EP 0322534 * 10/1988

* cited by examiner

*Primary Examiner*—Blair M. Johnson
(74) *Attorney, Agent, or Firm*—Drinker Biddle & Reath LLP

(57) ABSTRACT

A folding shade system includes a shade having a plurality of panels secured in an end-to-end fashion and cables suspended from opposite tracks to define a first curved profile. The folding shade system further includes at least one receiver for each of the cables secured to the shade to define a cable-receiving pathway extending across the width of one of the panels. The pathway defined by the at least one receiver has a second curved profile substantially matching the first curved profile of the cable. The at least one receiver for each cable may be a continuous sleeve defined by lines of stitching in joined end portions of adjacent panels or, alternatively, may include separate receivers each secured to the shade by a connector.

18 Claims, 9 Drawing Sheets

FOLDING SHADES HAVING MINIMAL SAG WHEN FOLDED

FIELD OF THE INVENTION

The present invention relates generally to shades, particularly folding shades having flexible panels that are folded as the shade is lowered to an open position.

BACKGROUND OF THE INVENTION

Convention centers, museums, and other public structures are often designed to include large sections of glass, or other light-transmissive materials, in the exterior walls or ceiling to admit into the structure as much natural light as possible. Portions of the walls or ceilings are often obliquely angled with respect to grade to optimize admission of light or simply for reasons of aesthetic design. The portions of the walls and ceilings can also be curved. It is often necessary or desirable to shade such sections from direct sunlight, or for privacy or other reasons. For such structures, a folding shade system is useful for shading of the angled portions of the structure.

Folding shade systems include shades having panels secured together in an end-to-end fashion. The shade is supported by rods or cables extending across the width of the shade and engaging the shade between adjacent panels. The rods or cables are attached to cars that translate along tracks located on opposite sides of the shade panels. Folding shade systems further include motor-driven pull cables connected to an end of the shade for lowering and raising the panels to respectively open and close the shade. When the shade is lowered, each of the panels is folded approximately in half as the panel-supporting cm approach the lower end of the tracks.

The rods or cables supporting the shade are subject to sag when suspended between the opposite tracks of the shade system. The sagging of the rods or cables causes bunching in prior art shade systems in the portions of the shades that receive the rods or cables. Such bunching in the rod or cable receiving portions of the shades impairs the folding of the supported panels leading to crumpling of portions of the panels, particularly adjacent opposite sides of the shade. This creates a bulky and unsightly construction rather than a compact collection of folded panels as desired.

SUMMARY OF THE INVENTION

In its broad aspects the invention comprises a shade system having a shade that includes at least one panel having a width and at least one elongated flexible member having opposite ends. Each of the flexible members is suspended from its opposite ends such that the flexible member defines a curved profile. The shade system further includes at least one receiver for each of the flexible members. The at least one receiver for each flexible member is operably secured to the shade to define a pathway extending across the width for receipt of the flexible member. The pathway defined by the at least one receiver has a curved profile.

In another aspect, the invention comprises a folding shade system having a shade that includes a plurality of panels each having opposite sides defining a width and opposite ends. The panels are secured together in an end-to-end fashion. The folding shade system also include a plurality of flexible cables each having opposite ends an d a pair of opposing tracks to which the opposite ends of the cables are securable. Each of the cables has a length that is selected such that the cable is suspended between the tracks to define a first curved profile. The folding shade system further includes at least one cable receiver for receiving each of the cables, the at least one cable receiver for each cable operably secured to the shade adjacent an end of one of the panels to define a cable-receiving pathway extending across the panel width. The cable-receiving pathway has a curved profile substantially matching the first curved profile.

DETAILED DESCRIPTION OF THE PREFERRED EMBODIMENTS

Figure 1:
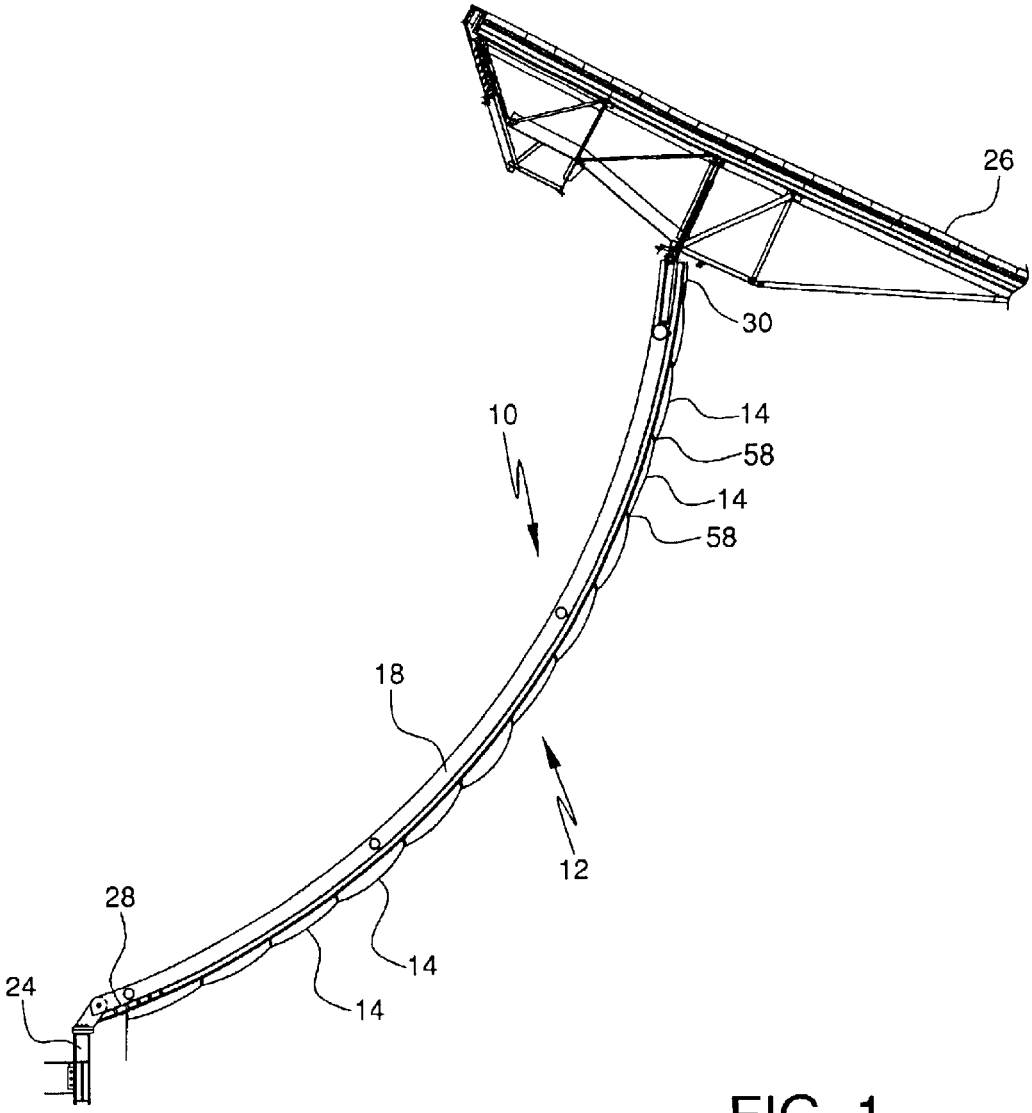
FIG. 1 i s a side view of a folding shade system according to the invention illustrating a closed folding shade.
Figure 2:
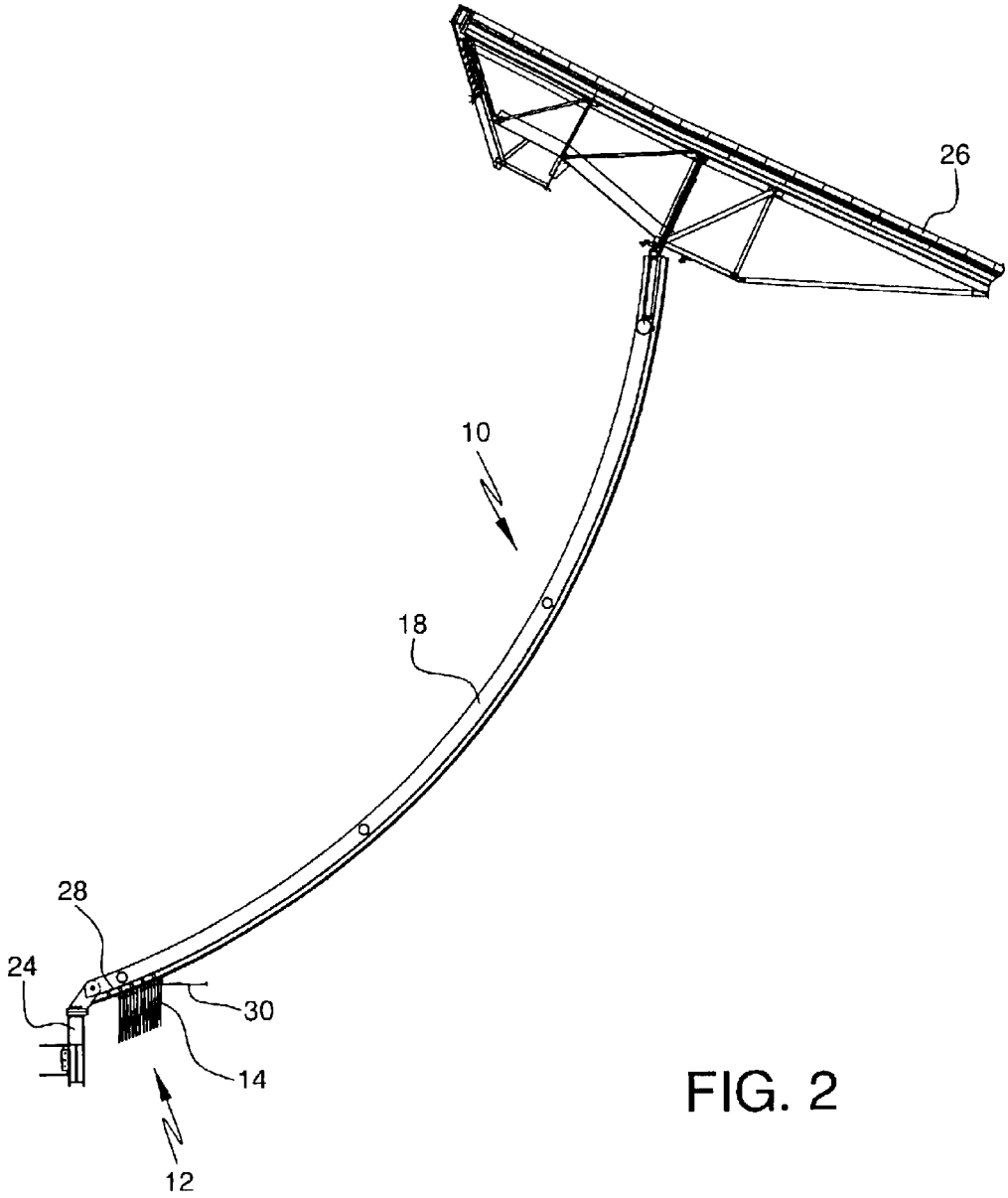
FIG. 2 is a side view of the folding shade system of FIG. 1 showing a fully open shade.

Referring to the drawings, where like numerals identify like elements, there is illustrated in FIGS. 1–2 a folding shade system 10 according to the present invention. The folding shade system 10 includes a shade 12 having a plurality of panels 14 secured together in an end-to-end fashion, as will be described in greater detail. The panels 14 of shade 12 are supported between opposing tracks 16 that are secured to supports 18. The supports 18 are secured at one end to a structure, which may be a wall 24 or other member and at the other end to an overhead member, such as ceiling or window frame 26.

The panels 14 of shade 12 are preferably made from a lightweight fabric material such as PVC coated polyester. The fabric of the panels 14 can be formed with an open weave construction to function as a sunscreen, or alternatively can be formed as an opaque blackout fabric to function as a sunblock. Only one side of the folding shade system 10 is visible in FIGS. 1 and 2 it being understood that the shade system 10 would appear as a mirror image in an opposite side view.

Figure 1A:
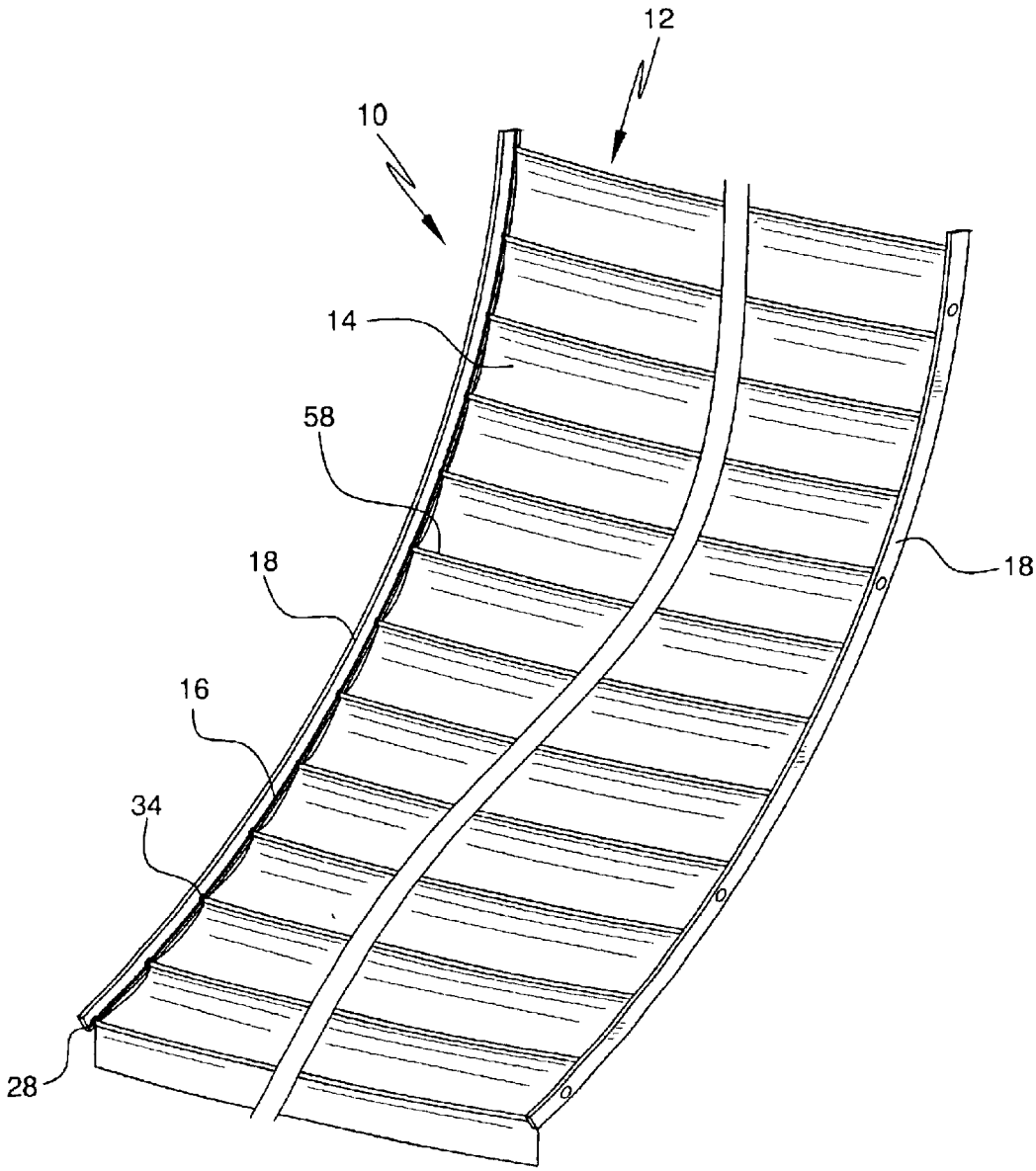
FIGS. 1A–1C are perspective views of the folding shade system of FIG. 1 respectively illustrating a fully closed, a partially open shade, and a fully open shade.
Figure 1B:
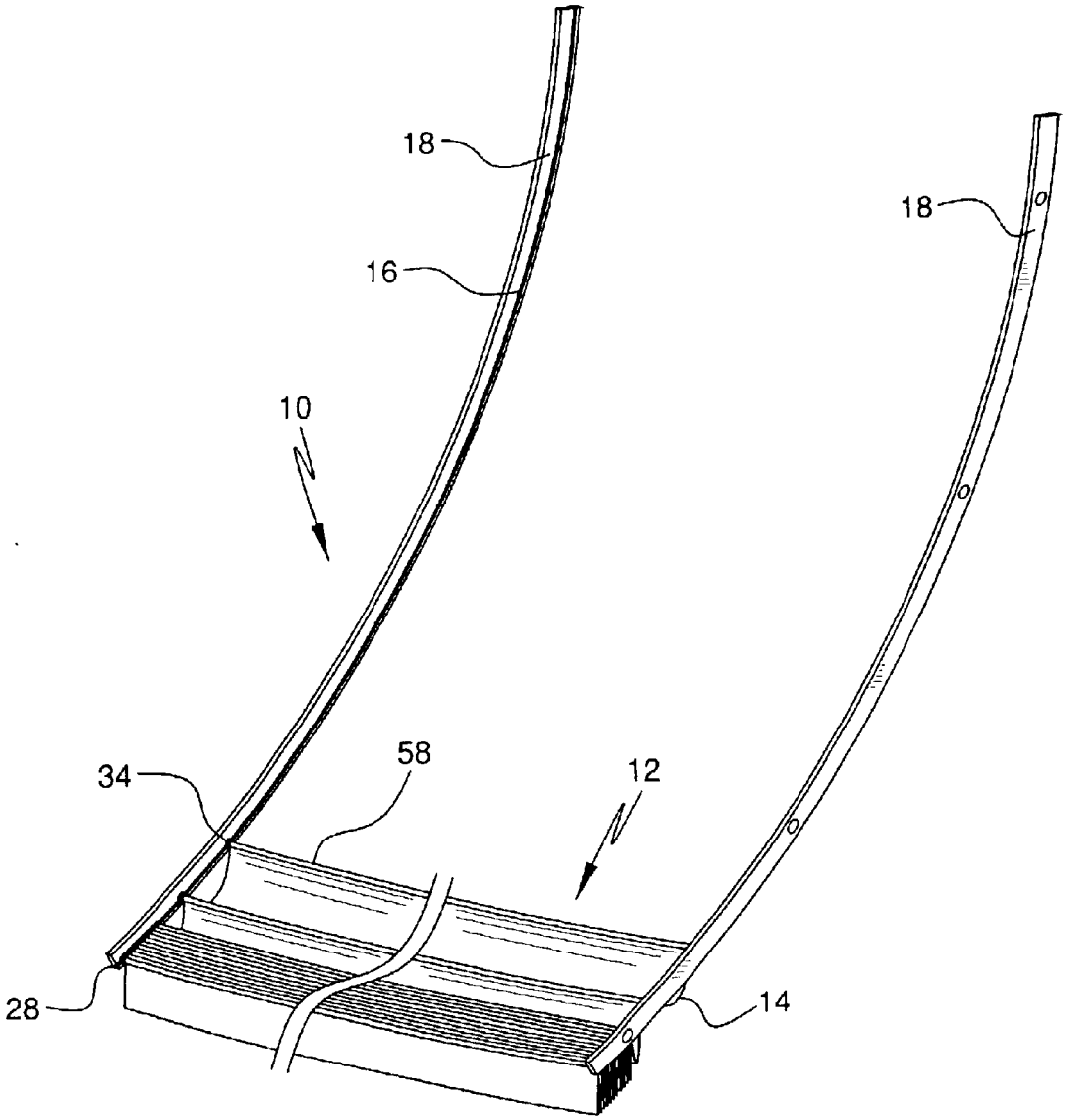
Figure 1C:
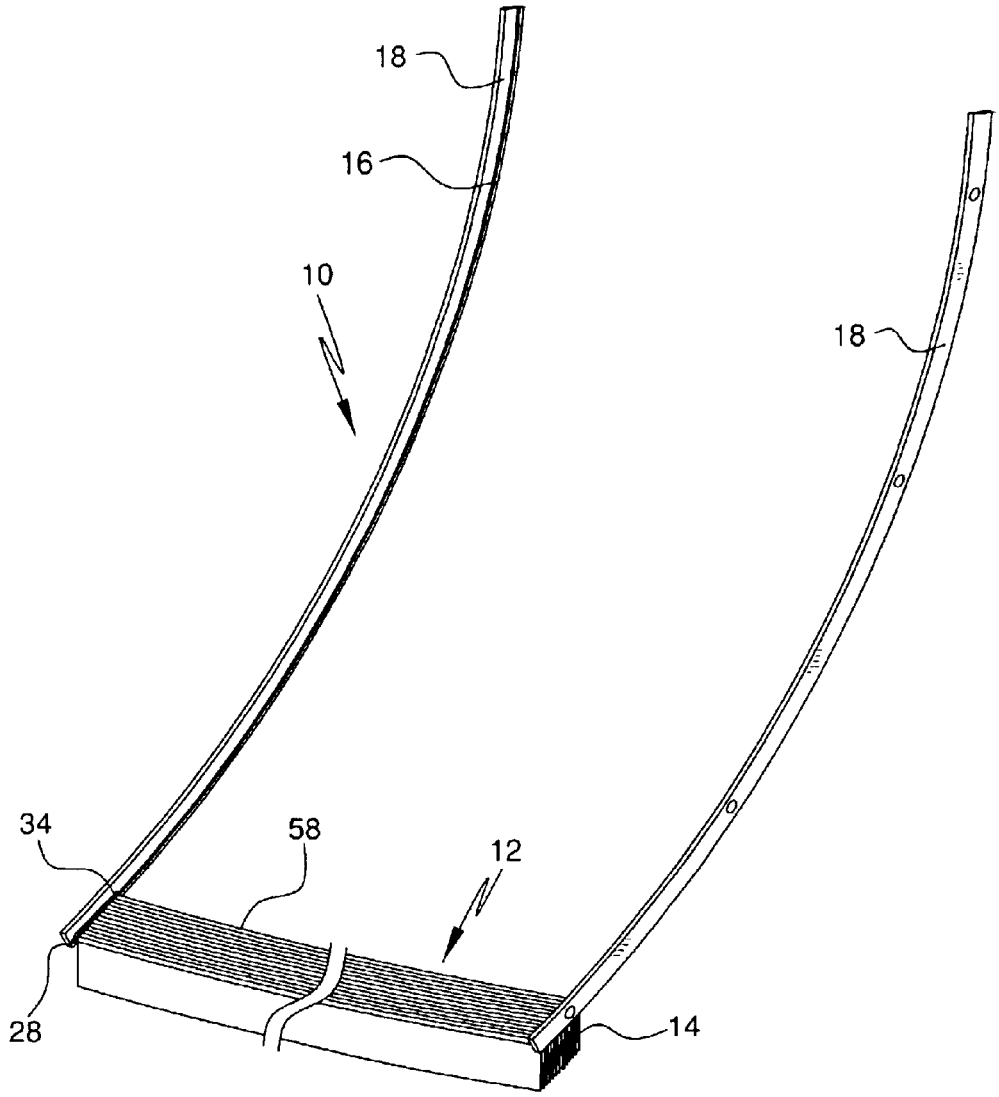

The shade 12 is connected to tracks 16 and supported for translation therealong for raising and lowering the panels 14 to respectively close and open the folding shade 12. The folding shade 12 is shown in FIGS. 1 and 1A in the closed position. In this position, the panels 14 have been raised along the tracks 16 to extend between the wall 24 and the ceiling 26. Referring to FIG. 1B, the shade 12 is lowered along the tracks 16 to a partially open position. As shown, when each of the panels 14 approaches the lower end of the tracks 16, it is folded lengthwise, approximately in half. The shade 12 is raised and lowered in the known fashion using motor-driven cables 30 connected to the uppermost panel 14.

Figure 3:
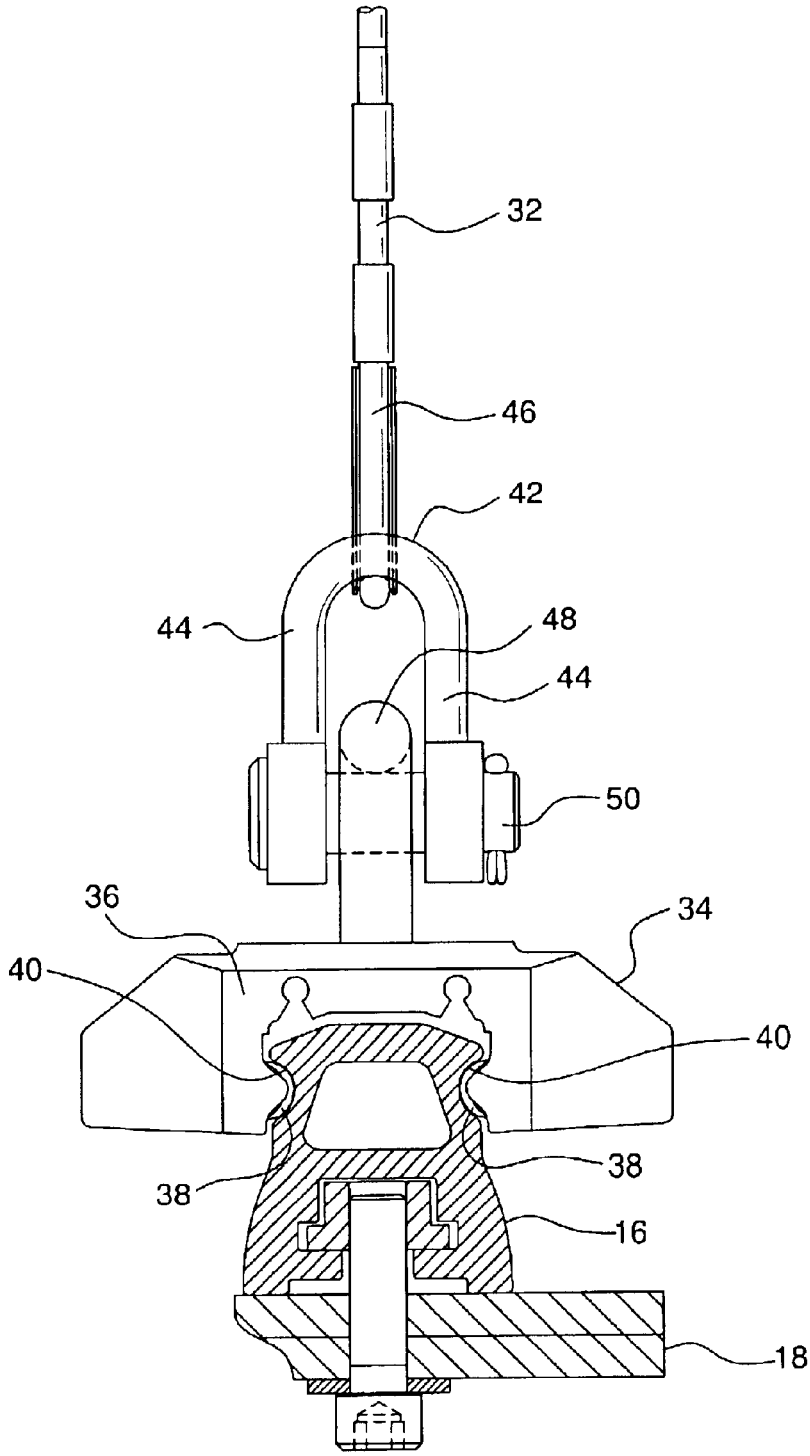
FIG. 3 is an end view, partly in section, of a cable car engaging one of the tracks of the shade system of FIGS. 1 and 2.

Referring to FIG. 3, the folding shade system 10 includes a plurality of cables 32 that extend across the width of the panels 14 between the opposite tracks 16. Each of the cables 32 engages the shade 12, in the manner to be described below, between adjacent panels 14 in joined portions of the panels. The cables 32 are secured at opposite ends to cars 34 each having a body 36 rotatably supporting wheels 38, or other suitable roller members. Grooves 40 in tracks 16 receive wheels 38 for rolling engagement to provide for translation of cars 34 along tracks 16. A clevis 42 having opposite arms 44 is secured to the ends 46 of the cables 32 to provide for attachment of the cables 32 to the cars 34. Each of the cars 34 includes a loop 48 secured to the body 36 of the car. A pin 50 is received through the arms 44 of the clevis 42 such that the pin 50 extends through the loop 48 of the car 34. The connection of the cables 32 in this manner provides a releasable connection of the shade 12 to the tracks 16 that facilitates removal of the shade 12 for repair or maintenance for example. The invention, however, is not limited to the clevis and pin connection shown in FIG. 3. Any suitable form of connection could be used to secure the ends of the cables 32 to the cars 34.

The cables 32, suspended between the opposite tracks 16, are subject to sagging deflection across the width of the panels 14. Gravity acting on the cables 32 causes this sagging deflection. In prior art shade systems, the sagging deflection of the suspended cables causes bunching of the shade in the cable-receiving portions of the shade. Such bunching of the cable-receiving portions of the shade impairs the lengthwise folding of the supported panels during opening of the shade resulting in crumpling of the panels during folding. Instead of forming neatly folded panels, as desired, the crumpling panels form a bulky and unsightly construction. The shade system 10 of the present invention provides for support of the shade 12 such that the shade supporting cables are permitted to sag without bunching of the cable-receiving portions of the shade. By limiting bunching of the cable-receiving portions of the shade in this manner, lengthwise folding of the supported panels along neat fold lines without crumpling of the panels is facilitated.

Figure 4:
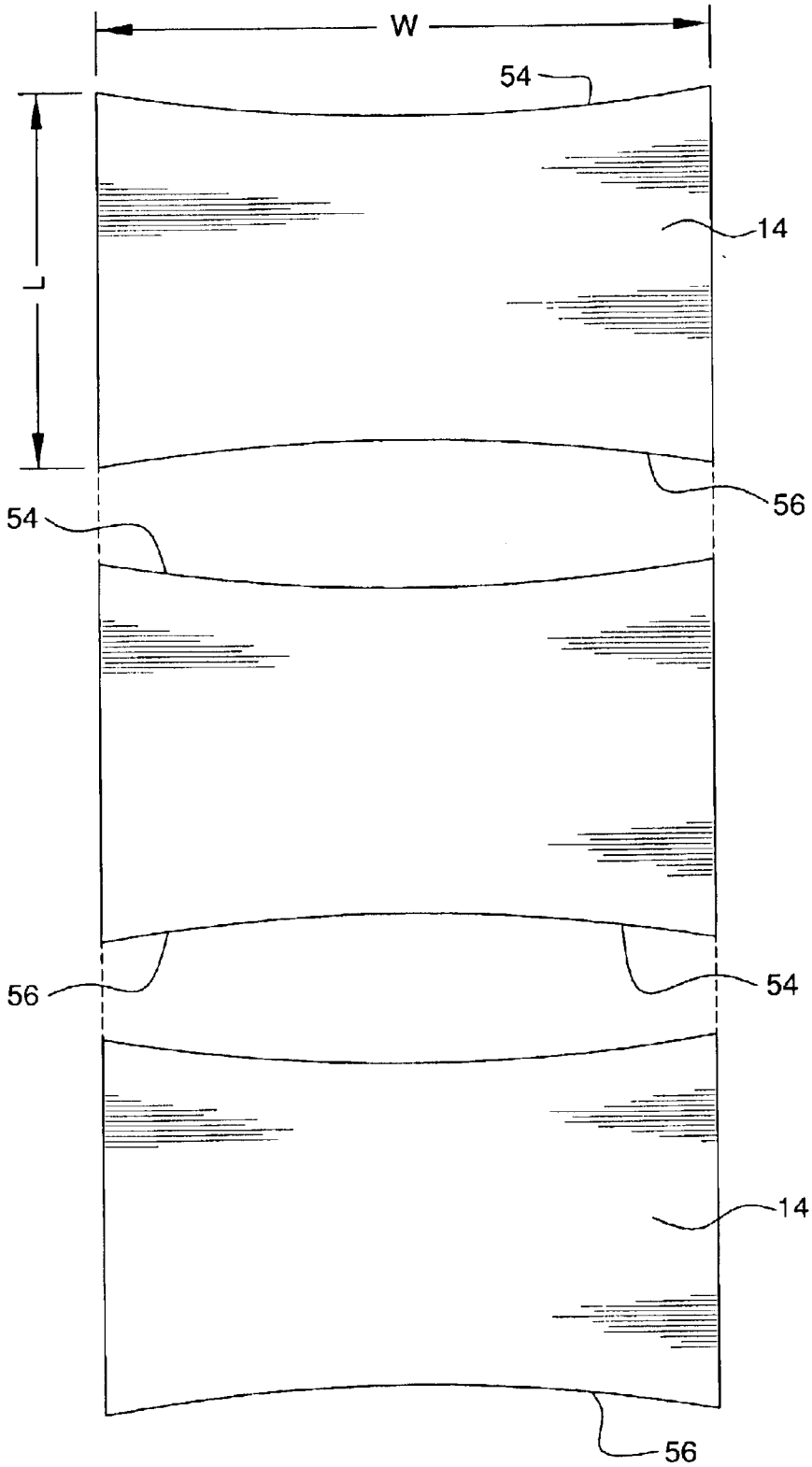
FIG. 4 is a front view of aligned panels of a folding shade according to the invention prior to being joined to form cable-receiving sleeves.
Figure 5:
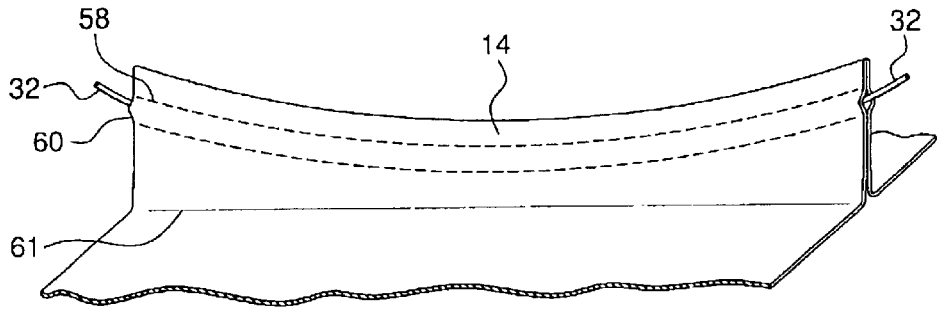
FIG. 5 is a perspective view of a joined edge portion between two of the panels of FIG. 4 receiving a cable.
Figure 6:
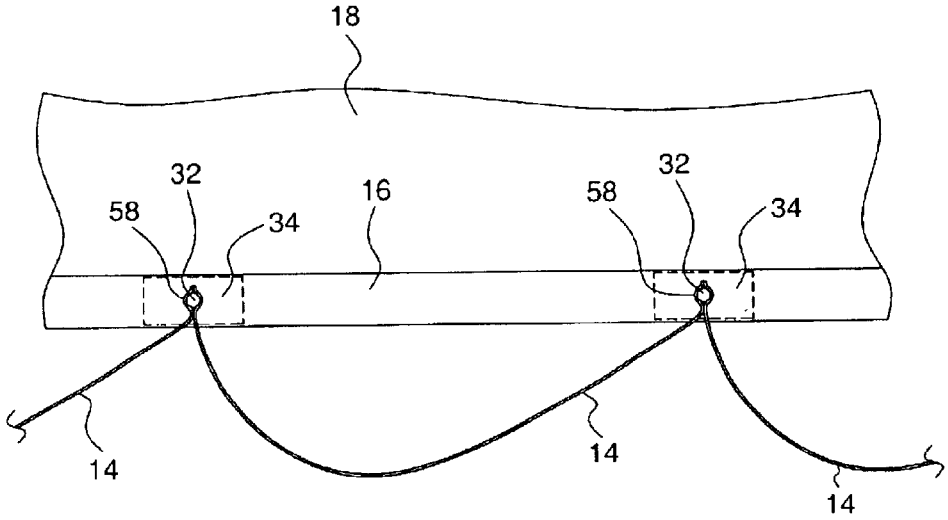
FIG. 6 is a partial side view of the shade system of FIG 1, with the track illustrated horizontally.

Referring to FIGS. 4 through 6, the construction of the shade 12, and its support by the folding shade system 10 to facilitate neatly folded panels 14, is shown in greater detail. Each of the panels 14 has a length L and a width W and includes opposite first and second edges 54, 56 at opposite ends of the length. The width of the panels 14 that is shown in FIGS. 4 and 5 is for purposes of illustration only, it being understood that the relative dimensions of the panels 14 is not critical to the invention and may vary from that shown.

As shown in FIG. 5, adjacent panels are secured to each other by lines of stitching 58, shown as dashed lines, extending across the width of the panels adjacent edges 54, 56. The ends 56, 54 of adjacent panels 14 may be joined by other means, such as by bonding the panels 14 together using a suitable adhesive. The lines of stitching 58 are spaced apart to define sleeves 60 that extend across the width W of the panels 14. The sleeves 60 are sized to define a pathway for receipt of the cables 32, as shown in FIGS. 5 and 6. In the event the panels 14 a re secured together using an adhesive, a conduit could be used to define a cable-receiving pathway extending across the width of the joined edge portions 54, 56 of the panels 14.

As shown in FIGS. 4 and 5, each of the first and second edges 54, 56 of a panel 14 is concavely curved with respect to the panel such that the edges curve inwardly. Therefore, the lines of stitching 58, extending adjacent edges 54, 56 to provide cable-receiving sleeves 60, will also be curved. It is not a requirement of the present invention, however, that the edges 54, 56 of the panels 14 be curved. Curved lines of stitching forming curved sleeves could be used to join adjacent panels.

As described above, gravity forces acting on the cables 32 cause each of the cables to define a curved profile when the cable is suspended from the opposite tracks 16 for supporting the shade 12. The cables 32 of the present invention have a length that is selected (and adjusted with turnbuckles if necessary) such that the cables are suspended from the opposite tracks 16 with a predetermined amount of sag. The present invention facilitates the formation of neatly folded panels 14, as the shade is lowered to the lower end of the tracks 16, in the following manner. As illustrated in FIG. 5, the curving profile defined by the cable-receiving sleeve 60 of shade 12 is selected to approximate the sagging profile that has been preselected for the cables 32. By approximating the sagging curvature of the cable 32 in the sleeves 60 in this manner, the supported shade hangs naturally and uniformly from the curved cables 32 without bunching occurring in the cable-receiving sleeves 60. The elimination of bunching from the sleeves 60 in this manner facilitates the formation of a neat fold line, such as fold line 61 illustrated in FIG. 5, across the width of the panels 14 without crumpling of the panels 14.

Referring to FIG. 6, a partial side view of the shade system 10 of FIG. 1 is shown. The portion of the shade system 10, which is inclined in FIG. 1, has been illustrated horizontally in FIG. 6. As illustrated in FIGS. 1 and 6, each of the panels 14 of the shade 12 will have a lengthwise curvature, even when the shade 12 has been raised along the tracks 16 to close the shade. As illustrated in FIG. 6, the lengthwise curvature in the panels 14 will not be symmetrical because of the inclination of the tracks 16.

Because of the non-symmetrical, lengthwise, curvature of the panels 14 caused by inclination of the tracks 16, the folding of each panel 14 as the respective leading car 34 for that panel is stopped will not involve a simple lengthwise folding of half-portions of the panel. Instead, each panel 14 will be required to roll upon itself along a fold line that will progress from the lower side of the panel 14 towards the middle of the panel as the upper (moving) car 34 approaches the lower (stopped) car 34. The extent that the panels 14 of the shade 12 will be required to roll upon themselves during lowering of the shade 12 will increase as the inclination of the tracks is increased. By allowing the shade 12 to hang naturally and uniformly without bunching, the present invention facilitates the required non-symmetrical panel folding along a traveling roll line without crumpling of the panels.

Figure 7:
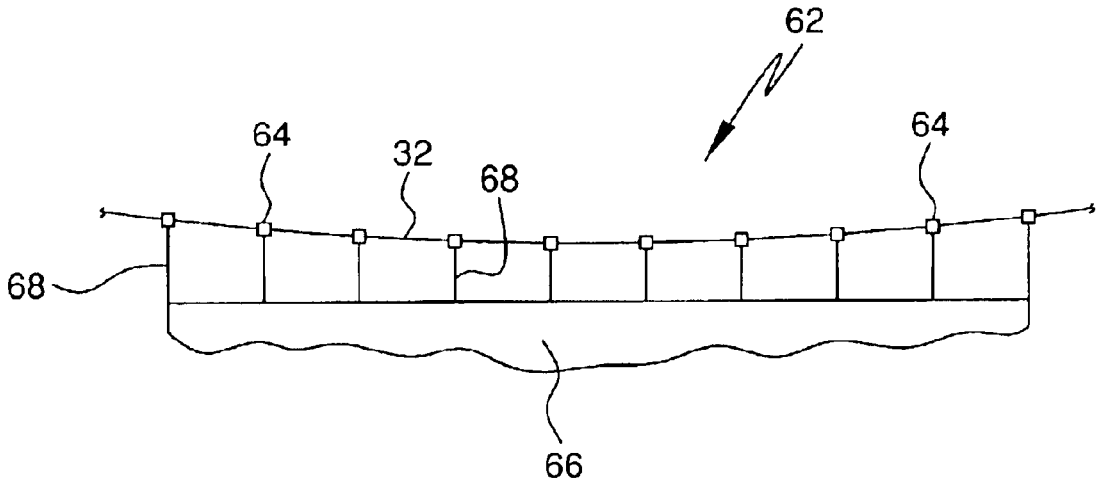
FIG. 7 is a schematic illustration of an alternative shade system according to the invention.

In the folding shade system 10 of FIGS. 1–6, the sleeves 60 extend continuously across the width of the panels 14 to receive cables 32. It is not a requirement of the invention, however, that the portions of the folding shade system 10 that receive cables 32 be continuous across the width of the panels 14. Referring to FIG. 7, an alternative shade system 62 according to the invention is shown. The shade system 62 includes a set of cable-receiving members 64 for each of cables 32. The members 64 of the set are secured to a joined portion 66 of adjacent panels of a shade (not shown) at spaced locations across a width of the shade. Each of the members 64, shown schematically as a ring-like element, receives the cable 32 to provide a localized point of support for the cable. Each of the members 64 is secured to the joined portion 66 by connectors 68, shown schematically as strand-like elements.

The length of the connectors 68 is varied across the width of the shade such that the members 64, each defining a localized point of support, collectively define a profile that is curved. The lengths for the respective connectors 68 are selected such that the curvature defined by the set of members 64 approximates the sagging curvature of a cable 32 suspended between opposite tracks (not shown) for support of the shade. As shown in FIG. 7, by selecting the length of the connectors 68 in this manner the shade hangs naturally from the cable 32 such that the cable-receiving members 64 are substantially uniformly spaced across the width of the panels. This uniform support of the shade, without bunching between the cable-receiving members 64, facilitates lengthwise folding of panels of the folding shade system 62 at the lower end of inclined tracks (not shown) of the folding shade system.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A shade system comprising:

a shade including at least one panel having a width;

at least one elongated flexible member having opposite ends, the at least one flexible member suspended at opposite ends and supporting the shade such that the flexible member defines a curved profile; and at least one receiver for each of the flexible members, operably secured to the shade and forming a pathway extending across the width for receipt of the associated flexible member, the pathway formed by the at least one receiver defining a curved profile when the shade is unsupported that substantially matches the curved profile of the suspended flexible member.

2. The shade system according to claim 1, wherein each panel has a length and wherein a flexible member is located at each of opposite ends of the length.

3. The shade system according to claim 1, wherein the at least one receiver for each of the flexible members comprises an elongated sleeve.

4. The shade system according to claim 3, wherein the sleeve extends substantially continuously across the width of the panel.

5. The shade system according to claim 1, wherein the at least one receiver for each flexible members comprises a plurality of spaced receivers.

6. The shade system according to claim 2, wherein the at least one panel includes a plurality of panels secured together in an end-to-end fashion.

7. The shade system according to claim 6, wherein end portions of adjacent panels are secured together and wherein the at least one receiver for each of the flexible members comprises an elongated sleeve defined by spaced lines of stitching applied to the end portions.

8. The shade system according to claim 6, wherein the panels are translatably supported.

9. A shade system comprising:

a shade including a plurality of panels each having a width and a length, each of the panels including opposite first and second ends each curved inwardly with respect to the panel, the panels secured together in an end-to-end fashion;

elongated flexible members having opposite ends and located adjacent each of the ends of the shade panels to support the shade, each of the flexible members defining a curved profile when suspended from its opposite ends; and at least one receiver for each of the flexible members, the at least one receiver operably secured to the shade to form a pathway extending across the width for receipt of the associated flexible member, the pathway formed by the at least one receiver for each of the flexible members defining a curved profile when the shade is unsupported that substantially matches the curved profile of the associated flexible member when it is suspended from its opposite ends.

10. A folding shade system comprising:

a shade including a plurality of panels each having opposite sides defining a width and opposite ends, the panels being secured together in an end-to-end fashion;

a plurality of flexible cables each having opposite ends;

a pair of opposing tracks to which the opposite ends of the cables are securable, each of the cables having a length that is selected such that the cable is suspended between the tracks to define a curved profile;

at least one cable receiver for receiving each of the cables, the at least one cable receiver for each cable operably secured to the shade adjacent an end of one of the panels to form a cable-receiving pathway extending across the panel width to support the shade when the cables are suspended between the tracks, each of the cable-receiving pathways defining a curved profile when the shade is unsupported that substantially matches the curved profile of the associated cable when it is suspended between the tracks.

11. The folding shade system according to claim 10, wherein the shade includes a plurality of panels secured together at respective ends to form joined end portions, each of the joined end portions defining a sleeve adapted for receipt of one of the cables.

12. The folding shade system according to claim 10 further including a plurality of cars each secured to an end of one of the cables, each of the cars rotatably supporting at least one roller member, the at least one roller member engaging one of the tracks for translation of the car therealong.

13. The folding shade system according to claim 12, wherein each of the cars includes a pair of roller members and wherein each of the tracks includes opposite grooves engageable by the roller members.

14. The folding shade system according to claim 13 further including at least one motor-driven pull cable secured to the shade for translation of the shade along the tracks.

15. A shade apparatus comprising:

a shade including a plurality of panels each having opposite sides defining a width and opposite ends, the panels being secured together in an end-to-end fashion;

a plurality of elongated flexible members each having opposite ends, each of the flexible members having sufficient flexibility to define a curved profile when suspended from its opposite ends;

a pair of spaced support members between which each of the flexible members is suspended for support of the shade the flexible members each defining a curved profile; and at least one receiver for each of the flexible members secured to the shade adjacent an end of at least one of the panels and forming a pathway to receive the associated flexible member, each pathway having a curved profile when the shade is unsupported substantially matching the curved profile of the associated flexible member when it is suspended between the spaced support members.

16. The apparatus according to claim 15, wherein the opposite ends of each of the flexible members are translatably secured to the support members.

17. The apparatus according to claim 15, wherein the at least one receiver for each of the flexible members includes an elongated sleeve extending substantially continuously across the width of the panel.

18. The apparatus according to claim 15, wherein the at least one receiver for each of the flexible members includes a plurality of spaced receivers each secured to the shade by a connector.

* * * * *